United States Patent [19]

Lovichi et al.

[11] 4,251,208

[45] Feb. 17, 1981

[54] PROCESS AND INSTALLATIONS FOR TRANSFERRING HEAT AND THEIR APPLICATIONS FOR THE TREATMENT OF RAW CEMENT

[75] Inventors: Jean-Pierre Lovichi; Bernard Le Bras, both of Montelinar, France

[73] Assignee: LaFarge Conseils et Etudes, Paris, France

[21] Appl. No.: 1,113

[22] Filed: Jan. 5, 1979

[30] Foreign Application Priority Data

Jan. 18, 1978 [FR] France ..... 78 01337

[51] Int. Cl.[3] ..... F27B 15/00

[52] U.S. Cl. ..... 432/14; 106/100; 432/15; 432/27; 432/106; 432/197; 432/215

[58] Field of Search ..... 432/14, 15, 27, 106, 432/197, 215; 106/100

[56] References Cited

U.S. PATENT DOCUMENTS

| | | | |
|---|---|---|---|
| 3,185,457 | 5/1965 | Boll et al. | 432/27 |
| 3,452,968 | 7/1969 | Shimizu et al. | 432/58 |

FOREIGN PATENT DOCUMENTS

| | | |
|---|---|---|
| 1473472 | 2/1967 | France . |
| 2280603 | 5/1974 | France . |
| 1128932 | 10/1968 | United Kingdom . |

*Primary Examiner*—John J. Camby

*Attorney, Agent, or Firm*—Schwartz, Jeffery, Schwaab, Mack, Blumenthal & Koch

[57] ABSTRACT

The present invention is directed to a process for transferring heat between two gases having different temperatures through the intermediary of a solid heat-carrier, which process may be possibly applied to the treatment of a raw cement. In said process a powderous or granular solid material is employed as the solid heat-carrier, the gases circulating in two different cascades comprising batteries of cyclones and said heat-carrier is used to recover at least a part of the heat carried along by the hot fumes issuing from a clinkerization furnace.

13 Claims, 9 Drawing Figures

PROCESS AND INSTALLATIONS FOR TRANSFERRING HEAT AND THEIR APPLICATIONS FOR THE TREATMENT OF RAW CEMENT

The present invention is directed to a process for transferring heat between two gases having different temperatures through the intermediary of a solid heat-carrier, which process may be possibly applied to the treatment of raw cement.

This invention concerns, among other things, cement manufacturing installations in which it is desirable to recover at least a part of the heat carried along by the hot fumes or gases, particularly by the fumes from a clinkerisation oven to a battery of cyclones, by the fumes issuing from a furnace equipped with a by-pass system or by the remaining hot gas available in a production unit of the same kind.

In the process according to the invention a powdery or granular solid material is employed as a solid heat-carrier between a first gas stream and a second gas stream circulating respectively in the first and the second cascade, the said solid material being injected in the first cascade for a first heat exchange with the first gas stream, then, after recovery by cycloning in one of the cyclones of the first cascade being injected, for a second heat exchange with the second gas stream circulating in the second cascade, then recovered by cycloning in a cyclone of the second cascade and at last re-used for a new heat exchange at a given level at one of the cascades, distinct effluent gases being evacuated at the top of each cascade.

According to an embodiment of the invention, the solid material evacuated from the cyclone of the second cascade is injected in a gas which is treated in a third cyclone, the gas evacuated from the top of said third cyclone constituting the gas stream entering the said cyclone of the second cascade, and the material evacuated at the bottom of said third cyclone being at least partially re-injected in the gas stream entering the said cyclone of the first cascade.

According to another embodiment of the invention, the gaseous effluent from the said cyclone of the second cascade, after addition of a powderous mass originating from a fourth cyclone, is injected in a third cyclone, from the bottom of which the solid mass evacuated is at least partially injected in the gas stream entering the fourth cyclone, while the gaseous effluent from this fourth cyclone, after addition of at least part of the solid material evacuated from the cyclone of the second cascade is injected in the cyclone of the first cascade. In a preferred embodiment, the second gaseous stream is a freshly-injected air flow. In general, the first gaseous stream is a hot gas stream and the second gaseous stream is a cold gas stream.

According to one embodiment of the invention, the solid material evacuated from the second cascade is at least partially injected for heat exchange in the said first gas steam. According to one embodiment of the invention, the second gaseous effluent evacuated from the second cascade is re-employed as a combustion gas in a pre-calcinator belonging to the first cascade.

The first gas stream is preferably a hot gas stream constituted by hot fumes coming from the clinker furnace and the solid material injected in this stream is a raw cement.

It is also possible that the solid heat-carrier is a raw material used in cement-making or a composite material chosen for its granulometry and density.

The solid material injected in the first gas stream, said stream being a hot gas originating from the oven, after leaving the second cyclone, thus after having been re-cooled, ensures at least partial trapping of the condensable vapours originating from this oven by quenching the said stream.

In fact, the material evacuated in the bottom of the cyclone ensures at least a partial quenching of the gas stream to which it is added. As will be seen hereunder, the process according to the invention may also be used in installations comprising pre-calcinators. This process is employed, in fact, in one or several cyclones of a battery of cyclones comprising at least two cascades, one of which comprises a pre-calcinator. Other aims and advantages of the present invention will appear on reading the following description and attached figures, which are given only by way of illustration.

Figure 1:
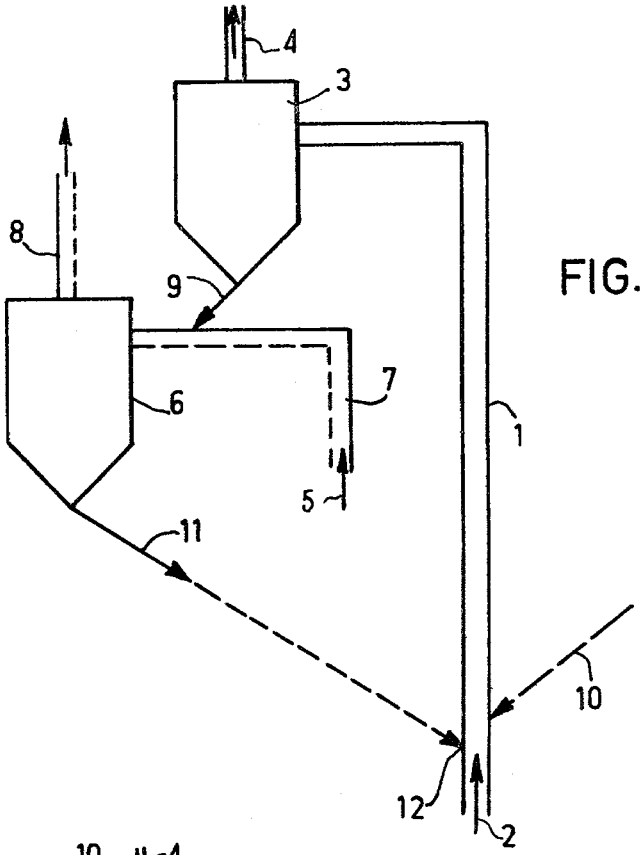
FIG. 1 is a schematic view of a heat exchange unit in a cement-making installation in which the process according to the invention is carried out. Such a unit is also called a "module".

Referring to FIG. 1, the unit which is schematically represented comprises two gas stream circuits, a first gas stream circuit comprising a conduit 1 for feeding a gas 2 to a first cyclone 3, this gas being then evacuated from the cyclone by a conduit 4, and a second gas stream circuit for feeding a gas 5 to a second cyclone 6 by a conduit 7, from which this second gas is evacuated from the cyclone by a conduit 8. The evacuation of solids from the cylone 3 through exit 9 is effected through conduit 7, upstream from cyclone 6.

According to the process of the invention, the solid powderous material, used a solid heat-carrier, is injected for example in 10, in the conduit 1, upstream of cyclone 3. This solid heat-carrier undergoes at first a heat exchange with the gas from 10 until it enters the cyclone 3. In the case when the gas 2 is hot, this gas being for example constituted by fumes issuing from a clinker furnace, the solid thus recovers the calories carried along by gas 2 and the temperature of this gas drops between points 10 and 4 so that a re-cooled gaseous effluent is thus evacuated in 4.

The same solid material when injected at 9 in the gas 5, which is presumed to be cold when entering the system, will transmit its calories to the latter gas before issuing from the system through the solid material exist 11 of cyclone 6.

A transfer of calories from the hot gas 2 to the cold gas 5 is thus realized. From this it may be inferred that if gas 2 is the cold gas and gas 5 the hot gas, a frigorific transfer is effected. It will appear obvious that the schema thus represented apply without any special adaptation to the case of frigorific transfer. The circuit in FIG. 1 constitutes an exchange module.

It is possible to re-cycle the solid material evacuated from cyclone 6, at least partially, in conduit 11, as indicated in dashes, this material being substituted for that injected in 10 or added to it.

The introduction of material in the hot gas, when the latter is constituted by fumes, ensures the quenching of this gas and avoids sticking while preventing particularly the pollution of the environment by fixing the volatile, noxious substances which are thus eliminated.

According to the case, a circulation of material, in an open or closed circuit, occurs.

Figure 2:
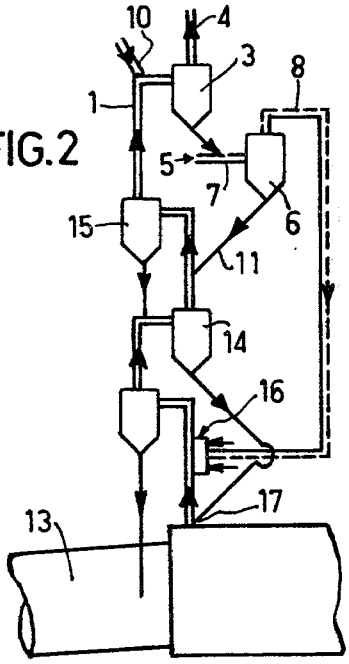
FIG. 2 illustrates two cascades of cyclones feeding a clinker furnace, realised according to the invention and comprising a pre-calcinator for the treated material.
Figure 3:
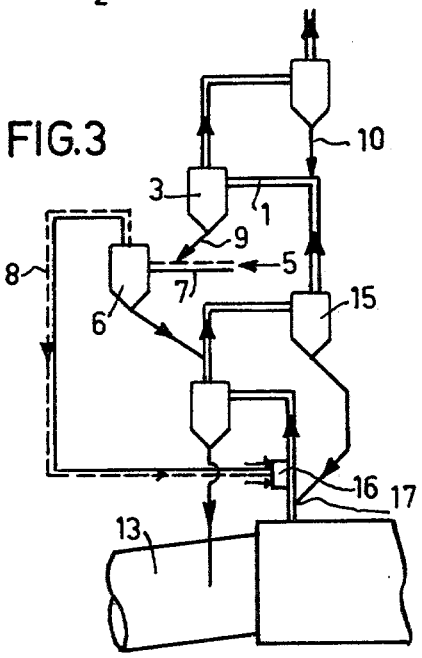
FIGS. 3 and 4 illustrate two cement-making installations which are variations of those of FIG. 2.
Figure 4:
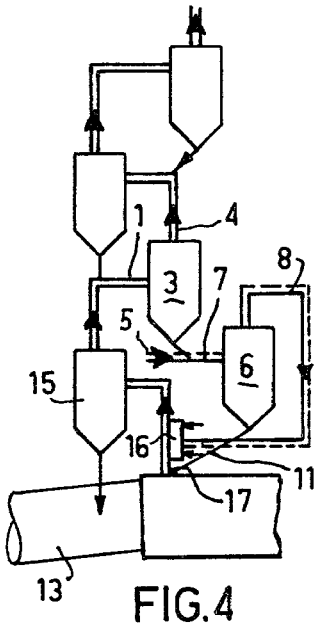

FIGS. 2 to 4 illustrate applications of the open circuit system in cement-making installations. For more clarity, the elements of the installations of FIGS. 2 to 4 have the same reference numerals as those used for elements of FIG. 1, when these elements are disposed in the same way and fulfill the same purpose in order to constitute an exchange module. This also applies to FIGS. 5 to 9. In the installations of FIGS. 2 to 4, consisting a standard cement-making tower with a battery of cyclones and a clinker furnace 13, a part or all of the material issuing from one stage corresponding to cyclone 3 is derived, exchanged with air, which is introduced in 5, before to be re-introduced in the entry flue of immediately preceding cyclone 6.

The exchange module according to the invention may be disposed at any stage of the tower. When it is located between the second and the third stage (FIG. 3) it may be fed with air pumped from the cooler.

In the present description, the first stage corresponds to the stage formed by the first cyclone on the path of the gases issuing from the furnace, the second is the following, et cetera.

The air heated in the cyclone 6 and evacuated at 8 then serves as combustion air in the second part of the reactor or pre-calcinator 16. This permits the realization of a pre-calcinator 16 (FIGS. 2 to 4). The material evacuated from the cyclone of the second stage [cyclones 14, 15 or 3 (by the intermediary of cyclone 6), respectively, in FIGS. 2, 3 or 4] is injected at the exit of the fumes chamber 17 in the form of a curtain of material. The fuel is injected with this combustion air before being heated.

FIGS. 5 to 9 illustrate the schema of installations using the module according to the invention in a closed circuit.

Figure 5:
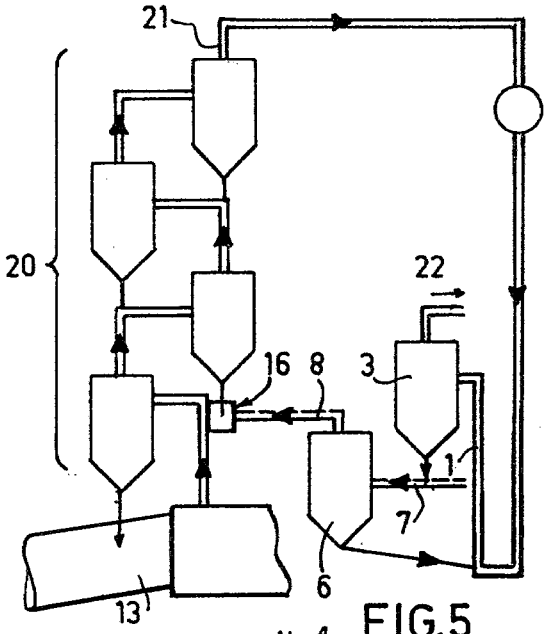
FIG. 5 illustrates another variation of the cement-making installation according to the invention, in which the solid heat-carrier operates in a closed circuit.

FIG. 5 shows a cement-making tower comprising an indirect gas-gas exchanger. The hot gases, evacuated at 21 from the tower comprising the battery 20 of cyclones are introduced in 1 in a supplementary cyclone, cyclone 3 of the module according to the invention. At the exit of cyclone 3, the gases may be employed for drying the raw material in 22. Between this cyclone 3 and the cyclone 6, fed with cold air through conduit 7, a material whose granulometry and density are compatible with a high output of cyclones is circulated according to the process of the invention. This material, acting as the solid heat-carrier will pass through three stages:

- re-heating by contact with the hot gases in cyclone 3,
- exchange of one part of the recovered calories with the cold air in cyclone 6
- recirculation in the cyclone 3.

This material may be one of the raw materials used in a cement-making plant or the raw cement itself. It may also be constituted by composite materials chosen by virtue of their granulometry and density.

The re-heated air thus recovered in 8 may be injected, as before, as furnace air at the level of the pre-calcinator 16 located at the base of the tower. It is possible to use more than one exchange stage according to the output desired and also the space available for the installation.

Figure 6:
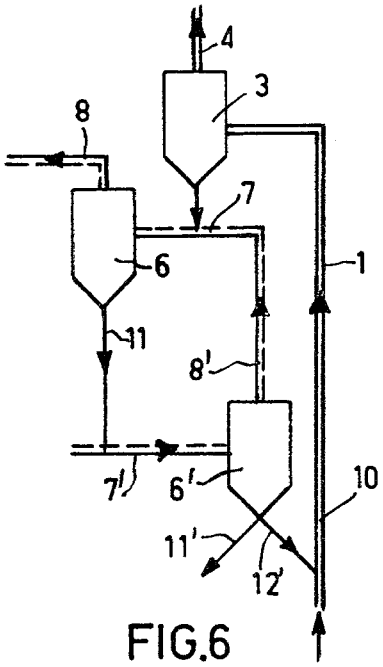
FIGS. 6 and 7 are two schema of cement-making installations comprising a fumes by-pass and providing a quenching of the gases emitted from the clinker furnace and a recirculation of dust evacuated from the furnace by this by-pass.
Figure 7:
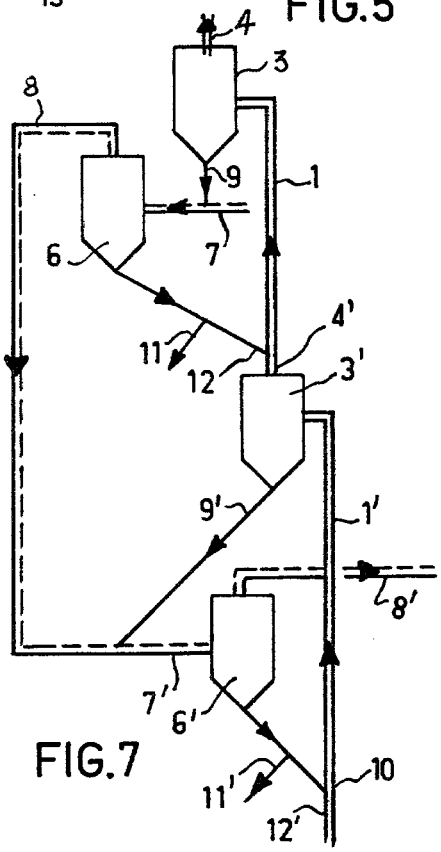

FIGS. 6 and 7 illustrate two circuits according to the invention and comprising a by-pass device having two functions of:

- quenching the gases by-passed not by the cold air but by the cold material (by acting more on the dilution aspect),
- recovery of part of the calories lost by thus deriving the gases evacuated from the furnace.

The process consists in re-circulating the dust evacuated from the furnace by the by-pass, and re-introducing it into hot fumes issuing from the furnace, after a heat exchange with air. Two functions are thus performed as regards the dust:

- since issuing at low temperature from the dust-exchanger, it efficiently quenches the fumes issuing from the furnace, while its temperature remains lower than sticking (or tacking) temperature;
- since re-introduced at this temperature in the air-dust exchanger, it heats the air while undergoing cooling thus achieving an efficient quenching of the fumes evacuated from the furnace.

A quantity of dust identical to that corresponding to the gases by-passed by the furnace is permanently evacuated from the system. The advantage of this system with respect to the standard by-pass is two-fold:

- through re-circulating, the dust issuing from the furnace traps more efficiently the volatile materials (especially the alcali sulphates), which may have remained in the gaseous state;
- this re-circulation of the dust allows cold air to be heated in order to use it as hot combustion air for a pre-calcinator.

It is also possible to feed the system with a material acting as a circulating charge and capable of efficiently trapping the vapours to be eliminated after issuing from the furnace.

Several lay-outs are possible, depending on whether a one-stage or a multi-stage material re-circulation is to be performed.

FIG. 6 shows an installation with single-stage trapping.

The dust evacuated from the furnace by the by-pass in 1 passes successively through cyclones 3, 6 and 6'; the air introduced by conduit 7' flows through the two latter cyclones, and is evacuated at 8 after re-heating. This re-heated air may be used as a combustion gas in a pre-calcinator or for other uses, for example heating, et cetera.

A quantity of dust equal to that introduced at 1 by the furnace gases is evacuated at 11' from cyclone 6'.

FIG. 7 shows a two-stage installation for calorific recovery and trapping. The dust evacuated from the furnace is introduced through 1' and 1 into the cyclones 3' and 3, and when issuing from these cyclones heats the air circulating through 7, 8 and 7' through the cyclones 6 and 6'.

Figure 8:
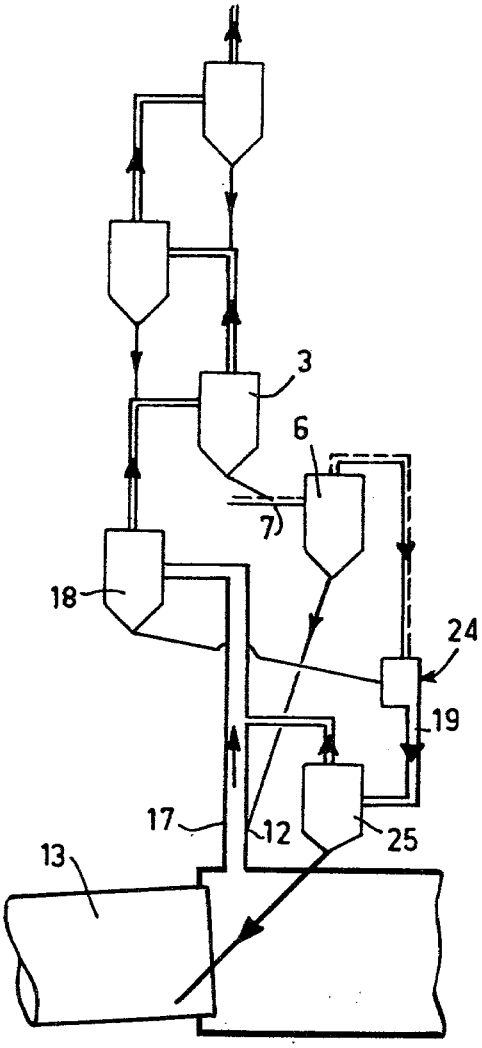
FIGS. 8 and 9 are the schema of two other cement-making installations comprising pre-calcinator systems.

This re-heated air issues at 8'. The dust re-cooled in cyclones 6 and 6' is re-injected at 12 and 12' in the dust conduits 1' and 1. The module according to the invention also allows the realisation of pre-calcinators according to the schema of FIGS. 8 and 9. Referring to FIG. 8, the module of base 3, 6 recovers the calories carried by the material issuing from cyclones 3 in order to re-heat the air introduced at 7.

The thus re-cooled material is injected in the form of a dust curtain at 17 at the base of the fumes chamber in order to quench the gases issuing from the furnace. It is recaptured by the gases, cycloned in cyclone 18 and directed through a downward flue to 24 where fuel is injected. The material thus decarbonated is separated from the fumes in a supplementary cyclone 25 before being directed into the furnace.

The fumes evacuated from cyclone 25 are re-introduced at the fumes chamber exit.

Figure 9:
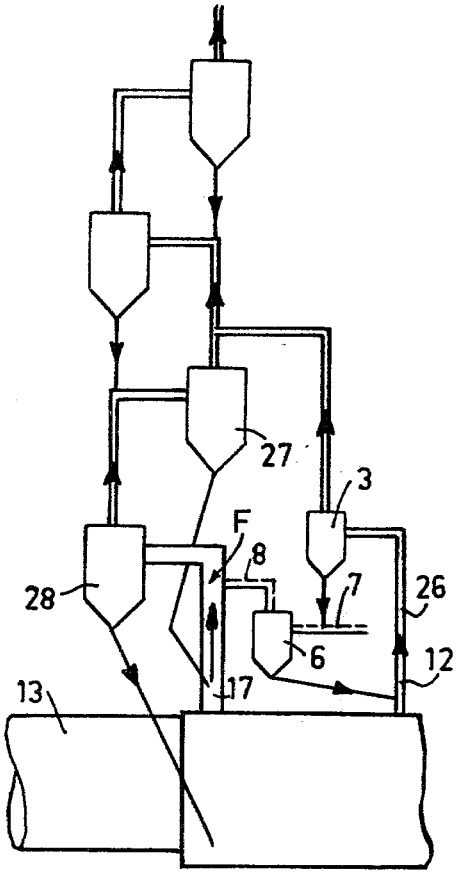

FIG. 9 shows another embodiment of a pre-calcinator.

Part of the gases evacuated from the furnace is derived at 26 towards cyclone 3, which is part of the module of the above-mentioned base, with re-circulation of the material. This module allows the air evacuated at 8 to be re-heated in order to act as furnace air in a pre-calcinator located at the base of the exchanger. The material recirculated and cooled by the combustion air is re-introduced at 12 at the base of the gas derived and evacuated from the furnace in order to limit the risks of concretions.

The material evacuated from cyclone 27 is injected in the form of a homogeneous curtain at 17 at the base of the fumes chamber, then taken up by the gaseous stream; it passes in front of the combustion air and fuel introduced zone F where it is decarbonated before being cycloned in 28 and directed towards the furnace.

Of course, the present invention is in no respect limited to the embodiments described and shown; it is open to many variations available to a man skilled in the art, according to the applications envisaged, while yet remaining within the scope of the invention.

According to an embodiment of the invention represented in FIG. 6, the material evacuated from the second cyclone 6 is injected into a gas which flows through conduit 7' and is treated in a third cyclone 6' from which the gas evacuated at the top by conduit 8' constitutes the cold gas stream mentioned above which is brought by conduit 7 into cyclone 6; the material evacuated at the bottom of cyclone 6' is at least partly re-injected in the hot gas stream by conduit 12.

According to another embodiment of the invention, represented in FIG. 7, the re-heated gaseous effluent issuing from the said cyclone 6 through conduit 8 is added to a powderous mass coming from cyclone 3' through conduit 9'. This effluent is then injected in a third cyclone 6' whose solid mass evacuated at the bottom is at least in part injected by conduit 12 into the hot gas stream of conduit 1, this stream being injected into a fourth cyclone 3' of which the gaseous effluent is evacuated through conduit 4' into which flows at least a part of the material collected in the bottom of cyclone 6, which is injected in cyclone 3.

What is claimed is:

1. A process for transferring heat between a hot gas stream circulating through a first cyclone cascade and a cold gas stream circulating through a second cyclone cascade comprising the steps of:

(a) introducing a solid particulate heat transfer agent into the hot gas stream circulating through said first cascade and passing said heat transfer agent with said hot gas stream in heat exchange relation through at least part of said first cascade;

(b) recovering hot heat transfer agent by cycloning said heat transfer agent from said hot gas stream in one of the cyclones of said first cascade;

(c) injecting said recovered heat transfer agent into said cold gas stream in said second cyclone cascade and passing said heat transfer agent with said cold gas steam in heat exchange relation through at least part of said second cascade;

(d) recovering cooled heat transfer agent from said second cascade by cycloning said heat transfer agent from said cold gas stream in a cyclone of said second cascade; and (e) re-employing said recovered cool heat transfer agent for further heat exchange at a desired stage of one of said first and second cascades.

2. A process according to claim 1, wherein the material evacuated from the cyclone of the second cascade is injected in a gas which is treated in a third cyclone the gas evacuated from the top of the third cyclone constituting the gas stream entering the second cyclone of the second cascade, and of which the material evacuated in the bottom is at least partially re-injected in the gas-stream entering in the said cyclone of the first cascade.

3. A process according to claim 1, wherein the gaseous effluent of the said cyclone of the second cascade, after the addition of a powdery mass coming from the fourth cyclone is injected into a third cyclone, the solid material evacuated at the bottom is at least in part injected into the gas stream carried into the fourth cyclone, the gaseous effluent of the latter, after addition of at least of the material evacuated from the cyclone of the second cascade, being injected into the cyclone of the first cascade.

4. A process according to any one of claims 1, 2 or 3, wherein the second gaseous stream is a newly injected air stream.

5. A process according to any of claims 1, 2 or 3, wherein the material evacuated from the second cascade is at least partially re-used for a heat exchange through injection into the said first gas stream.

6. A process according to claim 5, wherein the particulate heat transfer agent recovered at the bottom of the second cascade at least partially quenches the gas stream to which it is added.

7. A process according to claim 6, wherein the hot stream issues directly from a clinker furnace.

8. A process according to claim 1 further comprising the step of recovering a distinct gaseous effluent at the top of each of said first and second cyclone cascades.

9. A process according to claim 1, wherein the second gaseous effluent evacuated from the second cascade is re-employed as furnace air in a pre-calcinator belonging to the first cascade.

10. A process according to one of claims 1, 2 or 3, wherein the first gas stream is constituted by hot fumes issuing from a clinker furnace.

11. A process according to any of claims 1, 2 or 3, wherein the solid material injected into the first gas stream is a raw cement.

12. A process according to any of claims 1, 2 or 3, wherein one or several cyclones of a battery of cyclones connected to a clinker furnace are used.

13. A cement-making installation for carrying out the process according to any one of claims 1, 2 or 3.

* * * * *